US008631898B2

(12) United States Patent
Luoma

(10) Patent No.: US 8,631,898 B2
(45) Date of Patent: Jan. 21, 2014

(54) METHOD FOR ATTACHING PROTECTIVE STRUCTURE TO FEED BEAM, AND PROTECTIVE STRUCTURE IN ROCK DRILLING RIG

(75) Inventor: Lassi Luoma, Ylöjärvi (FI)

(73) Assignee: Sandvik Mining and Construction Oy, Tampere (FI)

( * ) Notice: Subject to any disclaimer, the term of this patent is extended or adjusted under 35 U.S.C. 154(b) by 0 days.

(21) Appl. No.: 13/504,354

(22) PCT Filed: Oct. 27, 2010

(86) PCT No.: PCT/FI2010/050854

§ 371 (c)(1),
(2), (4) Date: Apr. 26, 2012

(87) PCT Pub. No.: WO2011/051564

PCT Pub. Date: May 5, 2011

(65) Prior Publication Data

US 2012/0205190 A1 Aug. 16, 2012

(30) Foreign Application Priority Data

Oct. 28, 2009 (FI) ..... 20096109

(51) Int. Cl.

| | |
|---|---|
| ***G10K 11/04*** | (2006.01) |
| ***F16F 15/02*** | (2006.01) |
| *G10K 11/00* | (2006.01) |
| *F16F 15/00* | (2006.01) |

(52) U.S. Cl.

USPC ..... 181/200; 181/207; 175/162

(58) Field of Classification Search

USPC ..... 181/200, 198, 208, 207, 209, 205, 101; 175/162, 325.1, 424; 166/75.11; 173/DIG. 2

See application file for complete search history.

(56) References Cited

U.S. PATENT DOCUMENTS

| | | | | | |
|---|---|---|---|---|---|
| 1,935,536 | A | * | 11/1933 | Balduf | 52/346 |
| 2,136,315 | A | * | 11/1938 | Pettit | 299/37.4 |
| 3,536,149 | A | * | 10/1970 | Laird | 175/209 |
| 3,601,205 | A | * | 8/1971 | Kurt | 173/105 |

(Continued)

FOREIGN PATENT DOCUMENTS

| | | | | |
|---|---|---|---|---|
| EP | 546379 | A1 * | 6/1993 | D06F 37/22 |
| FI | 108561 | | 2/2002 | |

(Continued)

OTHER PUBLICATIONS

International Search Report for PCT/FI2010/050854 dated Jan. 31, 2011.

(Continued)

*Primary Examiner* — Edgardo San Martin

(74) *Attorney, Agent, or Firm* — Morgan, Lewis & Bockius LLP

(57) ABSTRACT

A method for attaching a protective structure to a feed beam of a rock drilling rig, and a protective structure for a rock drilling rig. The protective structure is at least partly arranged around the feed beam so that as the feed beam bends in a bending direction of its longitudinal axis and/or twists about its longitudinal axis in a twisting direction, the protective structure substantially maintains its original shape.

16 Claims, 7 Drawing Sheets

(56) References Cited

U.S. PATENT DOCUMENTS

| | | | | |
|---|---|---|---|---|
| 3,667,571 | A | 6/1972 | Fattelay | |
| 3,757,891 | A * | 9/1973 | Krieger | 181/205 |
| 3,955,472 | A * | 5/1976 | Frankiw et al. | 409/286 |
| 4,040,492 | A * | 8/1977 | Frederick | 173/1 |
| 4,402,383 | A * | 9/1983 | Bailey | 181/202 |
| 5,033,556 | A * | 7/1991 | Panzke | 175/62 |
| 5,298,693 | A * | 3/1994 | Heijn | 181/199 |
| 5,810,101 | A * | 9/1998 | Caraway et al. | 175/78 |
| 6,199,656 | B1 | 3/2001 | Vento et al. | |
| 7,730,973 | B2 * | 6/2010 | Haglund | 175/162 |
| 7,861,804 | B2 * | 1/2011 | Haglund | 175/325.1 |
| 8,061,449 | B2 * | 11/2011 | Haglund | 175/162 |
| 8,066,086 | B2 * | 11/2011 | Haglund | 175/325.1 |
| 8,177,023 | B2 * | 5/2012 | Peltola et al. | 181/200 |
| 2005/0011643 | A1 * | 1/2005 | Slack et al. | 166/242.1 |
| 2008/0142270 | A1 * | 6/2008 | Haglund | 175/162 |
| 2009/0266617 | A1 * | 10/2009 | Haglund | 175/325.1 |
| 2010/0116555 | A1 * | 5/2010 | Peltola et al. | 175/315 |
| 2010/0270083 | A1 * | 10/2010 | Haglund | 175/162 |

FOREIGN PATENT DOCUMENTS

| | | | | |
|---|---|---|---|---|
| JP | 04070416 | A * | 3/1992 | E02D 13/00 |
| JP | 5-295978 | | 11/1993 | |
| JP | 6-185055 | | 7/1994 | |
| JP | 2002-533597 | | 10/2002 | |
| JP | 2006-22568 | | 1/2006 | |
| JP | 2008-516115 | | 5/2008 | |
| JP | 2010-523846 | | 7/2010 | |
| JP | 2010-196467 | | 9/2010 | |
| SE | 523 874 | | 5/2004 | |
| WO | 00/39412 | | 7/2000 | |
| WO | WO 02070856 | A1 * | 9/2002 | E21B 7/02 |
| WO | 2006/038850 | | 4/2006 | |

OTHER PUBLICATIONS

Notification for Reason for Refusal (with English translation) for Japanese Patent Application No. 2012-535892, dated Jul. 2, 2013.

* cited by examiner

B-B

METHOD FOR ATTACHING PROTECTIVE STRUCTURE TO FEED BEAM, AND PROTECTIVE STRUCTURE IN ROCK DRILLING RIG

RELATED APPLICATION DATA

The present application is a U.S. National Phase Application of International Application No. PCT/F12010/050854 (filed 27 Oct. 2010) which claims priority to Finnish Application No. 20096109 (filed 28 Oct. 2009).

BACKGROUND OF THE INVENTION

The invention relates to a method for attaching a protective structure consisting of at least one block to a feed beam of a rock drilling rig and at least partly around the feed beam, the feed beam being movably arranged through a cradle to a boom of the rock drilling rig.

The invention further relates to a protective structure of a rock drilling rig, the structure being meant to be arranged at least partly around the feed beam of the rock drilling rig, the feed beam being movably arranged to a boom of the rock drilling rig through a cradle and the protective structure consisting of at least one block.

Rock drilling is typically carried out by using drilling equipment where a carrier is provided with one or more booms associated with a feed beam having a drilling machine movably mounted thereto. The feed beam is often movably mounted to the boom end by means of a separate cradle so that it can be placed into a desired position and direction for drilling. To accomplish these different movements of the boom and the feed beam the rock drilling rig is provided with transfer cylinders and hydraulic motors known per se and operable by pressure fluid.

Rock drilling causes noise, mostly at least due to the operation of the impact device of the rock drilling machine and the subsequent impact of the tool against rock and, further, because of the rotating movement and other possible functions. The noise thus created typically causes various problems. As the noise spreads fairly widely in the environment, problems increase particularly in the neighbourhood of inhabited areas. To avoid restrictions to working hours or work sites because of noise, an effort to solve the problem in surface drilling in particular has been to use different protective structures, such as noise dampening casings around the feed beam and the drilling machine.

Prior art solutions for noise dampening casings are disclosed e.g. in WO 2006/038850, WO 00/39412, SE 523874 and JP 5-295978. In the prior art solutions the aim is to provide as complete sound insulation as possible for structures that cause noise. However, the solutions fail to take into account the bending and twisting of the feed beam during operation. Because of this some of the loads directed to the feed beam are transferred through screw joints to the noise dampening casing thereby causing stress forces that make the casings susceptible to even surprising tearing.

In addition to noise, machine safety, for example, may cause problems and a need for protection in connection with rock drilling because moving parts constitute an occupational hazard and on work sites situated close to habitation also outsiders may be at risk. One solution for improving the safety of the person operating the machine, other people working on the site as well those present in the area is to protect the moving parts with a protective structure that prevents access too close to the moving parts during operation of the machine.

SUMMARY OF THE INVENTION

An object of the invention is to provide a novel and improved protective structure for a rock drilling rig and a method for attaching a protective structure to a rock drilling rig.

The method of the invention is characterized by attaching the block of the protective structure to the feed beam by attachment units so that the block substantially maintains its original shape as the feed beam bends in a bending direction of its longitudinal axis and/or twists in a twisting direction about its longitudinal axis due to forces acting on the feed beam during the use of the rock drilling rig.

The protective structure of the invention is characterized in that the block of the protective structure is provided with attachment units for attaching the block to the feed beam in such a way that when attached to the feed beam the protective structure substantially maintains its shape as the feed beam bends in the bending direction (B) of its longitudinal axis and/or twists about its longitudinal axis in the twisting direction (A) due to forces acting on the feed beam during the use of the rock drilling rig.

An idea of the invention is that the design of the protective structure of the rock drilling rig and/or the attachment thereof takes into account the twisting and/or bending of the feed beam during use, thus allowing the amount of forces transmitted to the protective structure by the bending and/or twisting to be minimized.

An advantage of the invention is that the magnitude of outside forces acting on the protective structure or each part thereof is minimized because undesired bending and twisting or torsion of the feed beam about the longitudinal axis thereof or other structure subjected to a load do not transfer the load to the protective structure, and the protective structure also substantially maintains its original shape. Since the invention allows the forces to be correctly directed, the structures of the rock drilling rig can be designed to better meet the requirements of their actual tasks and on the whole the structures can be made lighter and more affordable. Moreover, as outside loads are disposed of, the rigidity of the protective structure is easier to dimension and the protective structure is less susceptible to sudden tearing.

According to an embodiment the protective structure consists of at least two blocks. An advantage of this embodiment is that since the protective structure is made of a plural number of blocks, each block is subjected only to some of the forces caused by the twisting and/or bending of the feed beam, the forces being thus substantially smaller. By optimizing the number of blocks in relation to the length of the feed beam, it is thus possible to significantly reduce the forces transmitted to an individual block.

According to an embodiment the blocks may be interconnected by means of at least one connecting member that allows the parts to move in relation to one another. An advantage of this embodiment is that a protective structure made of a plural number of blocks that may move in relation to one another allows the blocks to be attached to the feed beam by a conventional fixed joint, for example, without any significant amounts of forces caused by the twisting and bending of the feed beam being transmitted to each block.

According to an embodiment a resilient sealing may be provided between the blocks of the protective structure to prevent noise propagation and to still allow the parts to move in relation to one another. An advantage of this embodiment is a good sound insulation of the protective structure even if the protective structure was made up of a plural number of blocks.

According to an embodiment at least one fastening element of the block comprises a joint. An advantage of this embodiment is that it provides a simple and affordable solution for significantly reducing the transfer of forces to the block due to bending and twisting of the feed beam.

According to an embodiment the block is provided with either one type A fastening unit and one type B fastening unit or with three type A fastening units for attaching the block to the feed beam, one type A fastening unit occupying or binding or fixing at least one linear degree of freedom and leaving all the rotation degrees of freedom flexible or free and comprising one or more fastening elements situated within an area of 1 meter in the direction of the longitudinal axis of the feed beam and placed linearly so that twisting about the longitudinal axis of the feed beam is possible, and one type B fastening unit occupying at least one linear degree of freedom and rotation about the longitudinal axis of the feed beam, leaving other rotation degrees of freedom flexible or free, and comprising one or more fastening elements located within an area of 1 meter in the direction of the feed beam. An advantage of this embodiment is that when the protective structure block is attached to the feed beam as described above, it is possible to substantially reduce the transfer of forces caused by the twisting and/or bending of the feed beam to the block.

According to an embodiment the protective structure is a noise dampening casing.

According to an embodiment the protective structure is a safety net.

LIST OF THE FIGURES

Some embodiments of the invention will be described in greater detail in the following drawings, in which FIG. 1*a* is a schematic general view of a rock drilling rig;

FIG. 1*b* is a schematic general view of a second rock drilling rig;

FIG. 2 is a schematic isometric view of a protective structure of a rock drilling rig;

FIGS. 3*a* and 3*b* are schematic isometric views of an over-supported joint between a protective structure and a feed beam;

FIGS. 4*a* to 4*c* are schematic isometric views of a joint between a protective structure and a feed beam;

FIGS. 5*a*, 5*b* and 5*c* are schematic side views of details of the joints in the different embodiments of FIGS. 4*a* to 4*c;*

FIGS. 6*a* and 6*b* are schematic top views of joints for joining together a block and a feed beam;

FIGS. 7*a* to 7*c* illustrate schematically an embodiment for joining a protective structure to a feed beam, FIG. 7*a* showing a front view of the embodiment, FIG. 7*b* a section along line A-A of FIG. 7*a* and FIG. 7*c* a partial section of a detail of FIG. 7*a;*

FIGS. 8*a* to 8*c* are schematic views of embodiments of a protective structure consisting of two or more blocks;

For the sake of clarity some embodiments of the invention are simplified in the drawings. In the figures like parts are indicated with like reference numerals.

DETAILED DISCLOSURE OF THE INVENTION

Figure 1A:
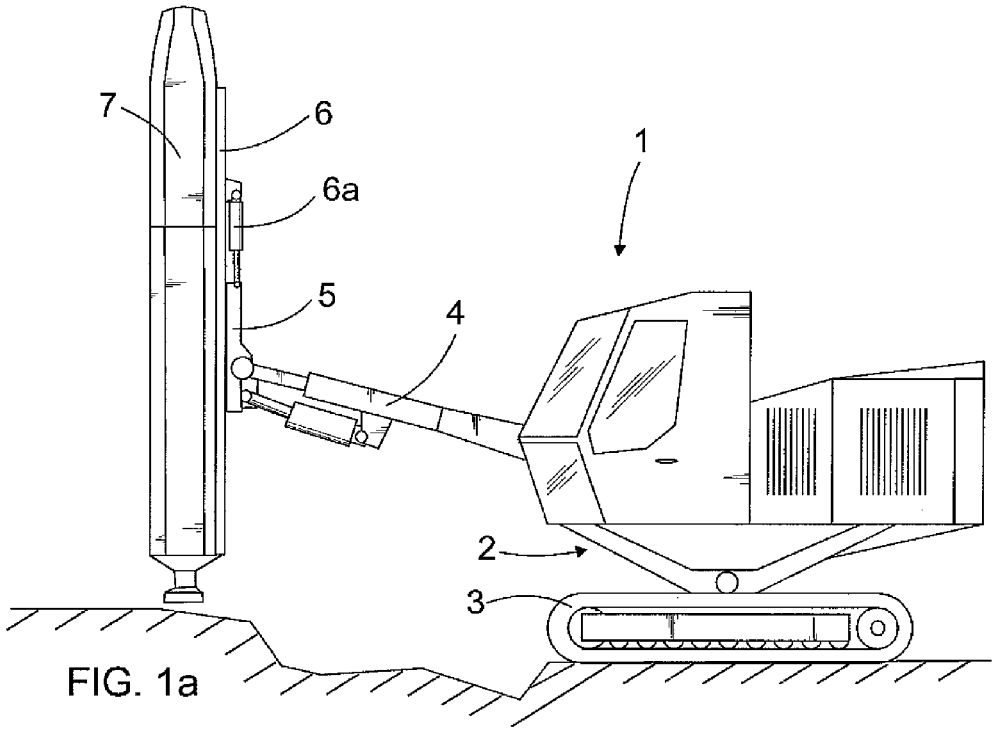
Figure 1B:
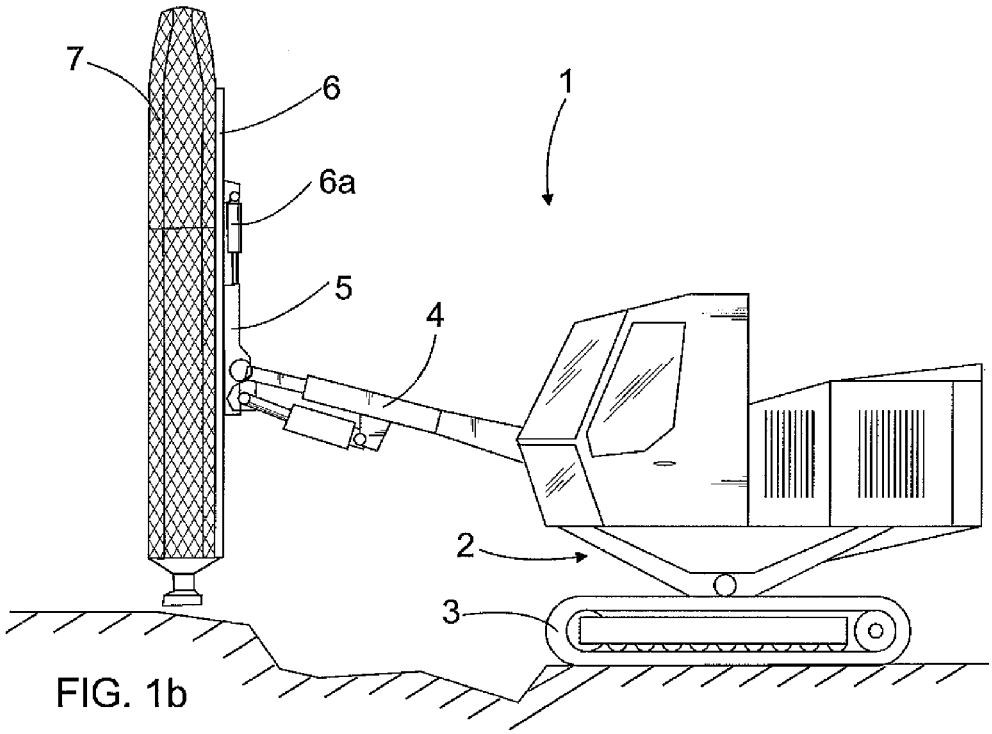

FIGS. 1*a* and 1*b* are schematic views of a rock drilling rig 1 that has a carrier 2. The carrier is usually provided with wheels or tracks, tracks 3 being used in this case by way of example. The carrier 2 has a boom 4 attached thereto in a manner known per se and the boom may consist of one or more boom parts, in a manner known per se, the figure showing one part by way of example. The boom 4 may be any boom structure known per se and there is no need to explain it in more detail. The boom 4 is pivoted to the carrier 2 in a manner known per se, which is not shown, to allow it to be turned in a manner known per se by power members, such as pressure medium cylinders or the like, to a desired angle in relation to the carrier.

At the other end of the boom 4 there is a cradle 5 pivotally connected to the boom, the cradle in turn being provided with a feed beam 6 movably attached thereto in the longitudinal direction thereof. The feed beam 6 may be moved in relation to the cradle 5 in a manner known per se by means of a pressure medium cylinder 6*a*. Mounted to the feed beam 6 there is a rock drilling machine, known per se and not shown here, for drilling holes by means of a drill rod and a drill bit known per se and attached thereto. The feed beam and the rock drilling machine and at least part of the drill rod are enclosed in a protective structure 7, which in FIG. 1*a* is a typical sound dampening casing that in the case of 1*a* consists of two different parts. In FIG. 1*b* the protective structure 7 is a safety net for preventing the user or outside persons from accessing the moving parts of the machine while it is in action.

The rock drilling rig 1 and the protective structure 7 implemented in the form of a sound dampening casing in FIG. 1*a* and the rock drilling rig 1 and the protective structure 7 implemented as a safety net in FIG. 1*b* provide only examples of a rock drilling rig and a protective structure arranged thereto. In fact the rock drilling rig may deviate greatly from the one shown in FIG. 1 and the protective structure may also be some other protective structure arranged to the rock drilling rig than a sound dampening casing, noise protection casing or safety net. In the embodiments of FIGS. 1*a* and 1*b* the protective structure is arranged to encase at least part of the feed beam, the rock drilling machine or the drill rod. Instead of a rock drilling machine the mining equipment to be protected with a protective structure may be any mining tool or similar equipment, such as a bolting device, injection device or the like, that is moved while in operation by means of a feed beam.

Prior art solutions have typically aimed at making the protective structure so strong and rigid that is sustains as well as possible also forces caused to the protective structure by the twisting and rotation of the feed beam. The most significant factor causing the feed beam to bend or twist is the feed force acting on the feed beam during the use of the mining equipment for pressing the drill rod of the rock drilling machine or the drill bit attached to the end thereof, or some other working part, against rock. However, such protective structures are typically susceptible for sudden tearings due to the magnitude of the forces and their poor predictability. Nevertheless, the primary task of protective structures, such as a noise protection casing or a safety net, is not to carry loads meant for the feed beam, and usually it is not purposeful to design protective structures so strong that they would participate in the carrying of the loads. Hence the solution of the invention aims at minimizing the amount of outside forces acting on the protective structure. This allows the protective structure to maintain its original shape while in use. Moreover, this protects the protective structure against tearing and other damages caused by outside loads.

In the solution of the invention the protective structure 7, such as a sound dampening structure or a safety net, is arranged at least partly around the feed beam 6 and the protective structure 7 may consist of one or more blocks 12. In normal use the feed beam 6 subjected to loads bends in the direction of its longitudinal axis and twists about its longitudinal axis. The block or blocks 12 of the protective structure 7 are attached to the feed beam 6 in such a way that as the feed beam 6 bends in a bending direction B of its longitudinal axis and/or twists about its longitudinal axis in twisting direction A the block 12 substantially maintains its original shape. This may be achieved by minimizing the amount of forces acting on the block 12 due to the bending and twisting of the feed beam 6. One way to minimize the amount of the forces acting on the block 12 is to attach each block 12 to the feed beam 6 by an attachment solution ensuring that the rotation or twisting direction A and the bending direction B of the feed beam are substantially free of over-support or excessive support, the concept of over-support being explained in greater detail below. The bending strength, flexibility and freedom of the joints, as they are defined in this specification, will be described in greater detail in connection with the disclosure relating to FIGS. 3*a* to 3*b* and 4*a* to 4*c*.

According to an embodiment the protective structure may consist of one or more blocks, each block being implemented to be self-supporting. In this case self-supporting means that each block bears the load caused by its own weight, for example, without requiring support from outside parts, such as attachment elements, for holding the structure together. This in turn allows the structure to be further attached to a counter piece, in this case to the feed beam, without the structure being subjected to outside forces either, which allows the structures to be designed to better correspond to their actual task, and they may be made lighter and more affordable. This also facilitates the dimensioning and design of the structures. Different embodiments are disclosed in greater detail below.

An individual piece, without any support, may move in six directions known as degrees of freedom: linear movement in x, y or z direction and rotation about the x, y or z axis. Hence a piece provided with support that binds, or prevents, exactly six degrees of freedom is supported in place in the direction of each degree of freedom and does not cause stresses or torsion forces. In theory such support binding the six degrees of freedom may be implemented by six support points, for example, so that each support point binds one degree of freedom. This may be implemented by providing the piece with three support points in the direction of a first plane, for example plane xy, with two support points in the direction of a next plane, such as plane yz, and with one support point in the direction of a last plane, such as plane xz. In other words, this kind of attachment supports the piece in place in the direction of all the degrees of freedom but does not cause what is known as over-support or excess support.

The above described support binding the six degrees of freedom is optimal for supporting the piece, but commonly used supports typically provide clearly over-support. For example, one fixed joint, such as a screw joint, alone binds all the 6 degrees of freedom. Hence a piece supported by four fixed joints, for example, has a support that already binds 24 degrees of freedom, which is clearly an over-support and easily causes, as such, stresses and torsion forces to the piece, thereby also transferring strong outside forces to the piece. However, this type of support, where the protective structure is fixedly attached to the feed beam by direct screw joints, for example, is very typical in prior art attachments for protective structures of rock drilling rigs, and the twisting and bending of the feed beam causes high loads to the protective structures, thus resulting to even sudden tearing and other damages in the protective structures.

Figure 2:
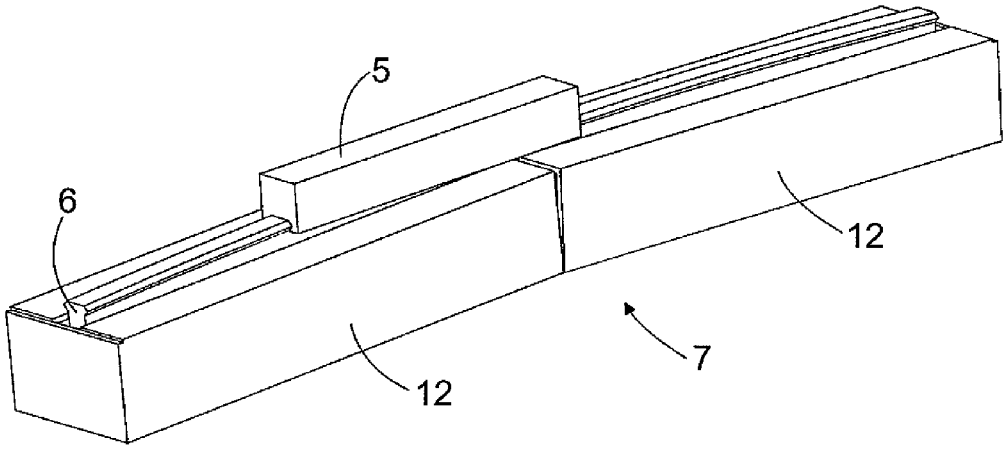

FIG. 2 is a schematic view of an embodiment of the protective structure 7. In the embodiment of FIG. 2 the protective structure consists of two blocks 12. In connection with the disclosure relating to FIGS. 3*a* to 3*b* and 4*a* to 4*c* below non-preferred and preferred solutions for joining the blocks 12 of the protective structure 7 and the feed beam 6 are described in greater detail.

In the embodiments of FIGS. 3*a* to 3*b* and 4*a* to 4*c* the joints consist of attachment units, where each attachment unit may consist of one or more attachment elements 13. The term 'attachment unit' refers to an attachment unit of type A, an attachment unit of type B or an attachment unit of type C, which will be defined in greater detail below. The definitions of the attachment unit types are based on the set of co-ordinates shown on the left in FIGS. 3*a* to 3*b* and 4*a* to 4*c*, a tolerance of 15 degrees being allowed in all directions of the axes. However, it is to be noted that the set of co-ordinates in FIGS. 3*a* to 3*b* and 4*a* to 4*c* only provides one example of how to define a possible set of co-ordinates and that the set of co-ordinates may also be defined in a number of other ways while the basic idea remains the same. The support is considered to be binding in a specific direction if the flexibility of the degree of freedom during use in the direction in question is less than 3 mm in a linear movement and less than 0.5 degrees in a twisting movement. The support is considered to be flexible in a particular direction if flexibility during use in the direction in question is 3 to 15 mm in a linear movement and 0.5 to 2 degrees in a twisting movement, with the end values of both the tolerances included. The support is considered to be free in a particular direction if flexibility during use in the direction in question is more than 15 mm in a linear movement and more than 2 degrees in a twisting movement.

In this disclosure a type A attachment unit refers to an attachment unit with at least one bound linear degree of freedom and whose rotating or twisting degrees of freedom are all flexible or free. One type A attachment unit may consist of one or more attachment elements 13. All attachment elements 13 located within an area of 1 meter in the direction of the x axis and linearly arranged so that rotation about the x axis is possible belong to one and the same type A attachment unit. If the attachment elements in a type A attachment unit are rigid, three degrees of freedom of the attachment unit, i.e. all its linear degrees of freedom, are bound. If the attachment elements in a type A attachment unit are flexible in one direction, the attachment unit has two bound degrees of freedom. If the attachment elements in a type A attachment unit are flexible in two directions, the type A attachment unit has 1 bound degree of freedom.

In this disclosure a type B attachment unit refers to an attachment unit where at least one of the linear degrees of freedom is bound and rotation about the x axis is bound of rotating or twisting degrees of freedom. Rotations about the y and the z axis are either flexible or free when support is provided by a type B attachment unit. The type B attachment unit may consist of one or more attachment members located within an area of 1 meter in the direction of the x axis irrespective of on which side of the feed beam 6 they are. If the attachment elements in the type B attachment unit are rigid, the attachment unit has one free degree of freedom, i.e. rotation about the z axis. If the attachment elements in the type B attachment unit are flexible in the x direction, the attachment unit has two or three free degrees of freedom. In that case movements in directions y and z and rotation about the x axis are bound. Rotation about the y axis is free if during a 15 mm flexibility of the attachment elements in direction x the mutual distance on plane yz of the attachment elements is shorter than 15 mm/sin 2°=430 mm. Rotation about the y axis is bound if the distance between the attachment elements with a flexibility of 15 mm in the x direction is 430 mm to 1720 mm, excluding the end values.

In this specification all attachment units binding at least a rotation or twisting movement about the y or the z axis are considered as type C attachment units, which are non-preferred as regards support and the transfer of forces.

Optimal support is achieved in a situation where the attachment elements of a type B attachment unit are rigid and bind five degrees of freedom, in which case rotation about the z axis is free, and the attachment elements of a type A attachment unit bind one direction, i.e. the direction along the y axis. Optimal support is also achieved if attachment elements of a type B attachment unit bind four degrees of freedom, i.e. all linear degrees of freedom and rotation about the x axis, and attachment elements of a type A attachment unit bind two degrees of freedom, i.e. directions along the y and z axes. In addition, optimal support is obtained if attachment elements of a type B attachment unit bind three degrees of freedom, i.e. linear degrees of freedom along the y and z axes and rotation about the x axis, and the attachment elements of a type A attachment unit bind three degrees of freedom, i.e. all linear degrees of freedom.

According to some embodiments attachment of the block 12 in the protective structure 7 to the feed beam 6 so that bending and twisting caused by the load of the feed beam 6 are not transferred on the protective structure is implemented by forming a joint with one type A attachment unit and one type B attachment unit or by forming the joint with three type A attachment units. FIGS. 3*a* to 3*b* and 4*a* to 4*c* show non-preferred and preferred ways of attaching the block 12 of the protective structure 7 to the feed beam 6.

Figure 3A:
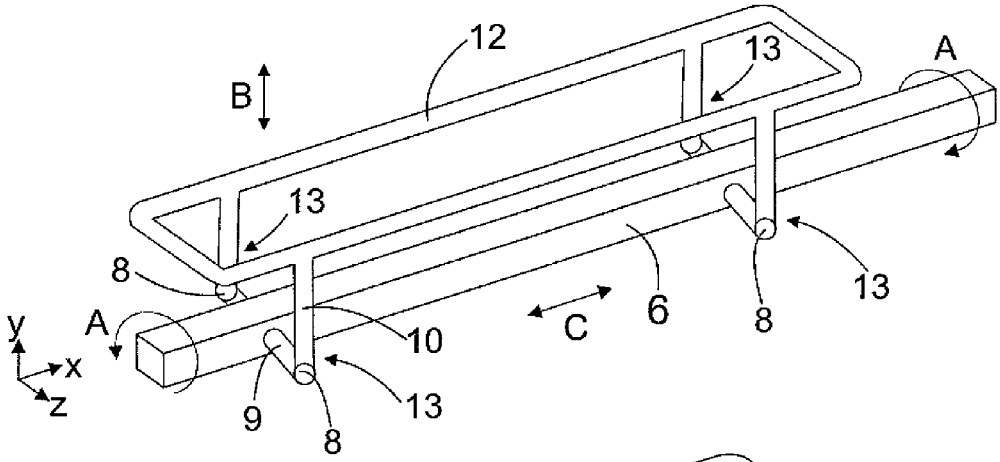

FIG. 3*a* shows a non-preferred solution for attaching the block 12 of the protective structure 7 to the feed beam 6. For providing a clear picture, the figure and the subsequent FIGS. 3*b* to 4*c* depict the block 12 of the protective structure only as a schematic frame, which may represent a support structure of the block 12 of the protective structure 7 or a part of the block 12 itself, depending on the embodiment. In FIG. 3*a* the block 12 of the protective structure is attached to the feed beam 6 by two attachment units, one of which is formed by two attachment elements 13 on the left in the picture and the other one by two attachment elements 13 on the right in the picture. The distance between the attachment elements is more than 1 meter.

Figure 5A:
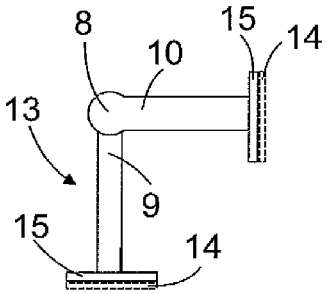

In this embodiment each attachment unit consists of two attachment elements 13 arranged on both sides of the feed beam 6, each attachment element 13 in turn consisting of at least a ball joint 8 and a first arm 9, one end of which is arranged to the feed beam 6 and the other end to the ball joint 8, and a second arm 10, one end of which is arranged to the block 12 and the other end to the ball joint 8. The principle of this type of attachment element may be as shown in FIG. 5*a*, for example. Each of these attachment elements 13 binds three degrees of freedom, i.e. all three degrees of freedom of a linear movement, but allows for all three rotation or twisting directions. Since the attachment elements 13 of each attachment unit are arranged at a distance from one another on substantially the same plane yz, each attachment unit in its entirety binds, nevertheless, the rotation movement taking place about the x axis. In other words, the attachment units of FIG. 3*a* are type B attachment units, if their attachment elements 13 are flexible enough in the linear direction x so that the rotation direction taking place about the y axis is also flexible, or, if not, they are type C attachment units and non-preferred already as such.

Each of the two type B attachment units described above thus form a support binding at least four degrees of freedom and together they form a support binding at least eight degrees of freedom, thus providing over-support, which is non-preferred. A particular problem with this method of attachment is over-support in twisting direction A of the feed beam, because it subjects the block 12 of the protective structure 7 to torsion forces and loads caused by the twisting of the feed beam, thus easily tearing and/or otherwise damaging the block 12.

Figure 3B:
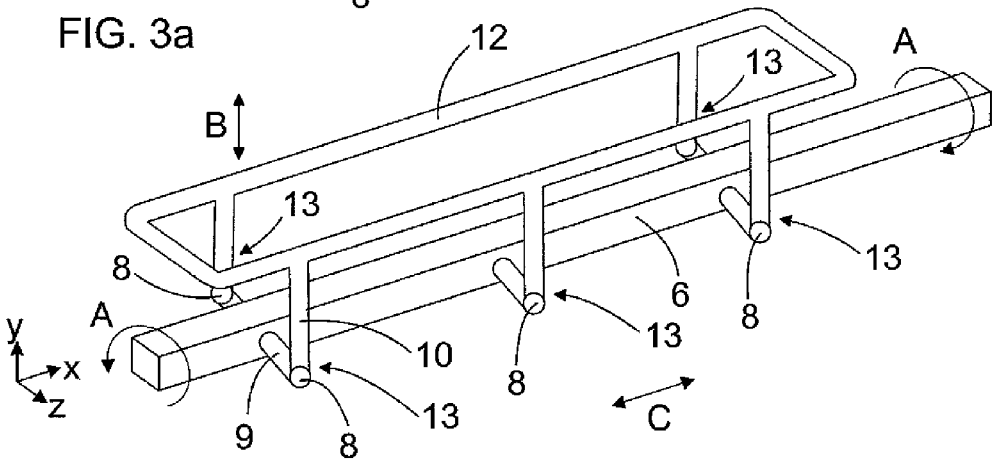

FIG. 3*b* shows another non-preferred solution for attaching the block 12 of the protective structure to the feed beam. The attachment solution is otherwise similar to the one in FIG. 3*a*, except here a fifth attachment element 13 is provided between the block 12 and the feed beam 6 in the central area of the feed beam 6 in longitudinal direction C thereof. This attachment element 13 resides at a distance of more than one meter of the other attachment elements 13 in longitudinal direction C of the feed beam 6 and thus forms in itself a third attachment unit binding three linear degrees of freedom but not degrees of freedom in the rotation or twisting direction. The attachment unit in question thus represents type A, the entire joint shown FIG. 3*b* consisting of two type B and one type A attachment units, whereby it is disadvantageous. As in the case of FIG. 3*a*, type B attachment units consisting of two attachment elements 13 form a support binding four degrees of freedom when the support in relation to rotation or twisting about the y axis is flexible, in addition to which the type A attachment unit forms a support binding three degrees of freedom, the block 12 in the protective structure 7 thus being supported by a support binding eleven degrees of freedom. This attachment solution is more clearly over-supported than the previous one and it also transfer forces caused by the bending of the feed beam 6 to the block 12, thereby increasing the load on the block 12 and damages caused due to it.

Figure 4A:
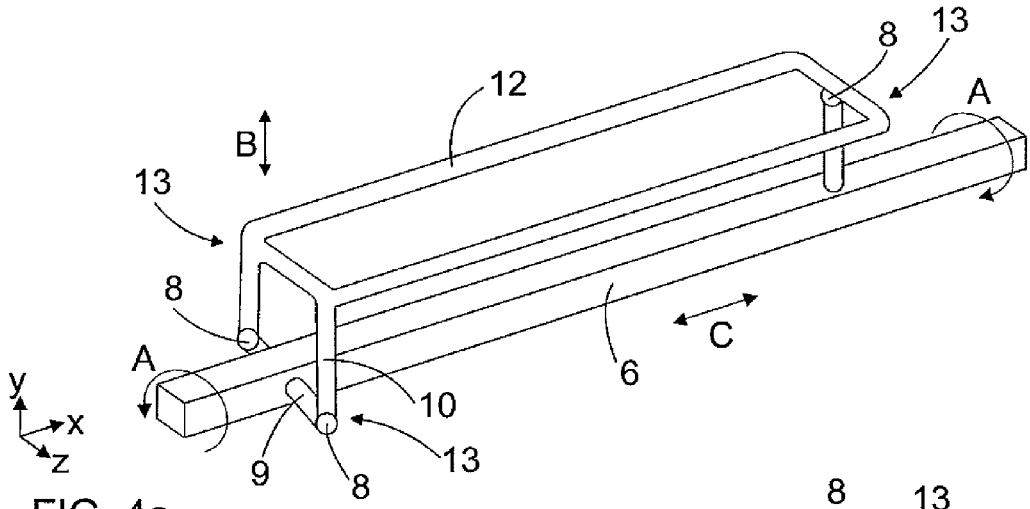

FIG. 4*a* shows a solution for attaching the block 12 to the protective structure 7. In the figure one end of the block 12, the one on the left, is provided with two attachment elements 13 facing away from each other on the sides of the feed beam 6 that are parallel with the bending direction B. Since the attachment members 13 are almost on the same plane yz at a distance from one another and if they bind linear directions in the direction of the y and z axes and the rotating or twisting movement about the x axis, but are slightly flexible in the direction of the x axis, allowing a flexible rotation or twisting in the direction of the y axis, they form a type B attachment unit with a support binding three degrees of freedom. The attachment elements 13 in FIG. 4*a* correspond to those in FIGS. 3*a* and 3*b*, i.e. they consist of at least a ball joint 8 and a first arm 9, one end of which is arranged to the feed beam 6 and the other end to the ball joint 8, and a second arm 10, one end of which is arranged to the block 12 and the other end to the ball joint 8.

Figure 5B:
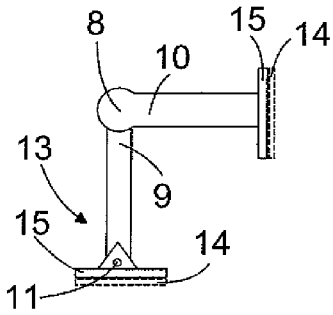
Figure 5C:
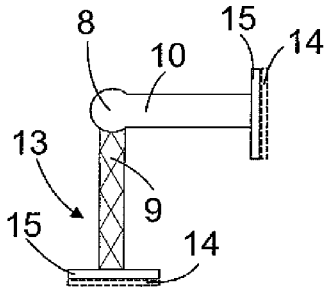

At the far end of the feed beam 6, on the right in the figure, the surface perpendicular to the bending direction B of the feed beam, i.e. the top surface in the figure, is provided with one attachment element 13, which may be similar to the one in FIG. 5*b* or 5*c*, for example. If the attachment element allows not only rotation or twisting movement but also a linear movement of the feed beam 6 and the block 12 in relation to one another in the longitudinal direction C of the feed beam, it only binds two degrees of freedom. This type of attachment element may be implemented for example by forming the attachment element 13 of at least a ball joint 8, a first arm 9 with one end thereof arranged to the feed beam 6 and the other end to the ball joint 8, and a second arm 10, with one end thereof arranged to the ball joint 8 and the other end to the block 12, at least one of the arms 9 and 10 being made flexible in the longitudinal direction C of the feed beam by selecting the material and/or construction. According to an embodiment this type of attachment element 13 may be formed of at least a ball joint 8 and a first arm 9, with one end thereof arranged to the feed beam 6 and the other end to the ball joint 8, and a second arm 10, with a one end thereof arranged to the ball joint 8 and the other end to the block 12 by a trunnion 11 to allow a linear movement of the feed beam 6 and the block 12 in relation to one another in longitudinal direction C of the feed beam. FIGS. 5*b* and 5*c* are schematic views of two possible embodiments of this type of attachment element 13. In that case the attachment unit formed of the attachment element 13 shown on the right-hand side in FIG. 4*a* binds two linear degrees of freedom and no rotating degrees of freedom, which makes it a type A attachment unit.

In other words, the attachment solution of FIG. 4*a* may consist of one type A attachment unit and one type B attachment unit. A support consisting of one type B attachment unit may bind four to eight degrees of freedom when the type B attachment elements are flexible in direction x.

Figure 4B:
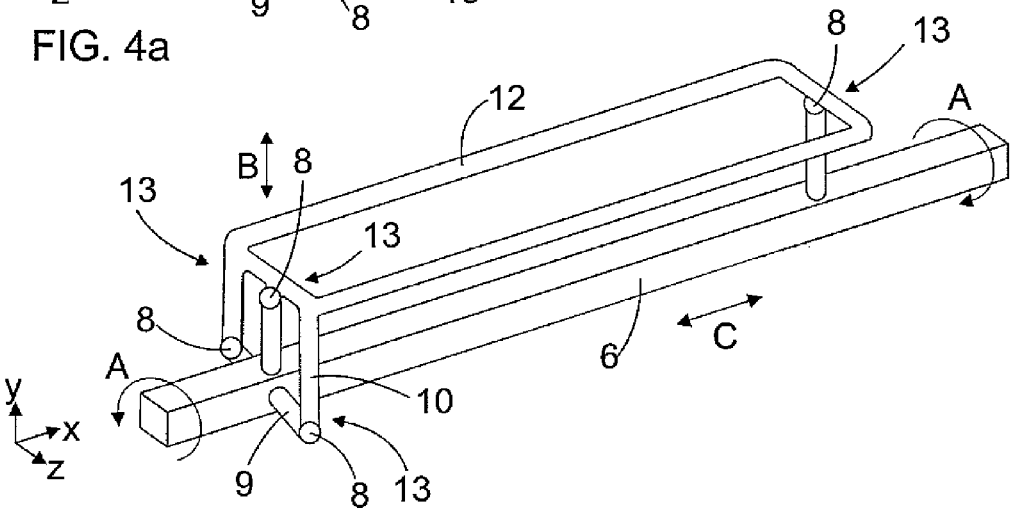

FIG. 4*b* further shows a solution for attaching the block 12 of the protective structure 7 to the feed beam 6. This solution is very much like the one in FIG. 4*a*, except that the end of the block 12 on the left in the figures is not provided with two but with three attachment elements 13 with an additional attachment element being arranged on the same side of the feed beam 6 as the attachment element 13 at the far end. Since the three attachment elements 13 on the left in the figure are at a distance of less than 1 meter from one another in the longitudinal direction C of the feed beam 6, they form one attachment unit. If this attachment unit binds at least one linear movement and rotation or twisting taking place about the x axis, the attachment unit in question represents type B. If the attachment elements in the attachment unit are rigid, the attachment unit of FIG. 4*b* has no degrees of freedom free, but all six of them are bound, whereby the support is a type C attachment unit. If the attachment elements of the type B attachment unit are flexible in the x direction, the type B attachment unit has one, two or three free degrees of freedom. In that case the bound or occupied degrees of freedom are those along the y and z axes and the rotation or twisting about the x axis. In addition, rotations or twistings about the y and z axes may be free, flexible or bound. The attachment unit on the right in the figure is a type A attachment unit and may function as disclosed in connection with FIG. 4*a*. With reference to the previous example as regards a type A attachment unit, the support according to FIG. 4*b* may bind five to eight degrees of freedom. This type of attachment solution also enables fairly well both the twisting of the feed beam 6 in rotating or twisting direction A and the bending in bending direction B, because the joint is not necessarily over-supported in these directions that are essential for the protective structure 7 when subjected to strain.

Figure 4C:
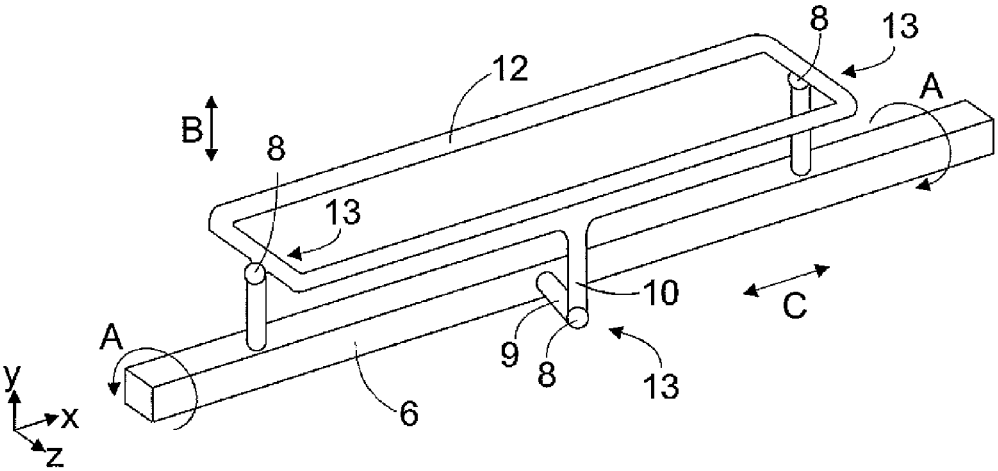

FIG. 4*c* shows yet another solution for attaching the block 12 of the protective structure 7 to the feed beam 6. In this embodiment the joint is formed by three attachment elements 13, all of which are at a distance of more than 1 meter from one another in longitudinal direction C of the feed beam, each of them thus forming a separate attachment unit. Each attachment unit may bind one to three linear degrees of freedom, while all degrees of freedom in the rotation or twisting direction may be free or flexible, all the attachment units thus being type A attachment units. In other words, in FIG. 4*a* the joint may be formed by three type A attachment units with a total number of three to nine bound degrees of freedom. An example of an optimal support in the attachment of FIG. 4*c* might be one in which the attachment unit on the left-hand side end binds all three linear degrees of freedom, i.e. the directions of the x, y and z axes, while the attachment unit on the right-hand side end binds two linear degrees of freedom, i.e. the directions along the x, y and z axes, the attachment unit in the middle only binding one linear degree of freedom, i.e. the direction along the y axis, whereby altogether six degrees of freedom are supported.

If the attachment element is a hinge, it provides support for five degrees of freedom. However, if the element used to attach the hinge is flexible to the extent that it allows a flexible rotation or twisting, the hinge provides support for four degrees of freedom. If the attachment of the hinge allows rotation or twisting in both directions, the element as a whole only binds three degrees of freedom.

FIG. 5*a* is a schematic view of an embodiment of the attachment element 13. The attachment element 13 may consist for example of at least a ball joint 8 and a first arm 9, one end of which may be arranged to a first piece to be attached, such as the feed beam 6, and the other end to a ball joint 8, and a second arm 10, one end of which may arranged to a second piece to be attached, such as the block 12, and the other end to the ball joint 8. The attachment element 13 may be further provided with fastening flanges 15, for example, for fastening the attachment element 13 to the first and the second pieces to be attached. This type of attachment element alone binds three linear degrees of freedom. Between the attachment element 13 and the first and/or the second piece to be fastened may be further provided a resilient attenuator 14 that prevents noise, for example, from penetrating from one piece to another but allows independent movement of the parts in relation to one another. Another way to attenuate noise is to make the ball joint from rubber, the rubber ball joint thus stopping any noises. This type of ball joint binds linear degrees of freedom but is often flexible or free in rotation or twisting directions.

FIG. 5*b* is a schematic view of a second embodiment of the attachment element 13. Here the attachment element 13 may consist for example of a ball joint 8, a first arm 9, one end of which may be arranged to a first piece to be attached, such as the feed beam 6, and the other end to the ball joint 8, a second arm 10, one end of which may be arranged to a piece to be attached, such the block 12, and the other end to the ball joint 8, and a trunnion 11 allowing the first arm 9 to be attached to the first piece to be attached, as shown in the figure, or the second arm 10 to the second piece to be attached. The attachment element 13 may be further provided with fastening flanges 15, for example, for fastening the attachment element 13 to the first and the second piece to be attached. This attachment element alone binds two linear degrees of freedom. In addition, between the attachment element 13 and the first and/or the second piece to be attached may be provided a resilient attenuator 14 that prevents noise, for example, from travelling from one piece to another but allows independent movement of the parts in relation to one another. Alternatively, noise attenuation may be implemented by making the ball joint from rubber, as disclosed above.

FIG. 5*c* is a schematic view of a third embodiment of the attachment element 13. The attachment element 13 of the figure may consist for example of a ball joint 8, a first arm 9, which is flexible in a selected direction or directions either due to its material or construction and one end of which may be arranged to a first piece to be attached, such as the feed beam 6, and the other end to the ball joint 8, and a second arm 10, one end of which may be arranged to a second piece to be attached, such as the block 12, and the other end to the ball joint 8. The first arm 9 may be made of a flexible material or in a construction that allows the arm to yield, for example, to a selected direction under load, such as longitudinal direction C of the feed beam. This type of attachment element 13 may bind either one or two linear degrees of freedom, because the arm may be flexible in two directions. In different embodiments the first arm 9 may be replaced or complemented by a second arm 10 providing flexibility in a selected direction, such as the longitudinal direction C of the feed beam.

As stated above, an optimal support with regard to the transfer of tensions, torsion forces and external forces by binding six degrees of freedom may be implemented for example by joining the pieces together with one fixed joint. However, when large moving objects are concerned, such as the feed beam and the protective structure arranged thereto, dimensioning of this type of joint is usually challenging and, to ensure a secure joint, it should be made strong in a way that is usually not practical technically, operationally and in view of costs. Nevertheless, in comparison with prior art attachment solutions, supports binding six degrees of freedom such as those described above may be used to significantly reduce forces transmitted to the protective structure. By selecting over-supported degrees of freedom, if any, in such a way that the rotation or twisting direction A and the bending direction C of the feed beam are not substantially over-supported or excessively supported, it is still possible to minimize extra loads caused to the protective structure 7 by the twisting and bending of the feed beam 6. If the attachment unit allows a movement of 3 to 15 mm or a rotation or twisting of 0.5 to 2 degrees as disclosed above, with the end values of the tolerances included, over-support is not caused, because in that case the support is considered flexible in a particular direction and therefore a situation of over-support, although possible in theory, is not harmful for the structure.

The supports presented in the above embodiments binding one, two or three degrees of freedom, which bind one, two or three linear degrees of freedom, are at least mostly shown implemented by means of a ball joint 8. This is, however, only to simplify the disclosure. Corresponding supports binding one, two or three degrees of freedom may also be implemented by making the attachment elements 13 either of a resilient material, such as rubber, for example in the form of rubber vibration attenuators, or of elements made of metal, for example, and providing structures that are flexible in a particular direction and yield under load, such as diverse springs or plates. Moreover, different embodiments of the attachment element 13 may be implemented using structural solutions, such as different slide or lever solutions. Further still, a support allowing for the required degrees of freedom may be provided using different combinations of the above solutions.

Figure 6A:
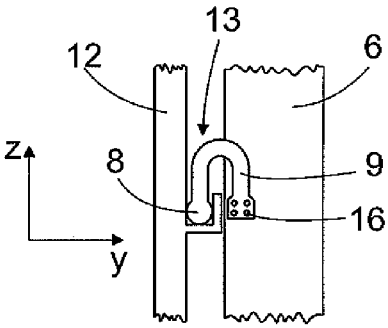

The above embodiments also show that the attachment element 13 consists of at least a first arm 9, a second arm 10 and a ball joint 8. However, one or more attachment elements 13 may have structures that deviate from this for example in that they only have a first arm 9, one end of which may be arranged to a first piece to be attached and the other end to a second piece to be attached. In that case the material and/or construction of the arm may be selected to allow a support corresponding to the one shown in the embodiment examples implemented with a ball joint. FIG. 6*a* is a schematic view of an example of this type of attachment element 13 for attaching together the block 12 and the feed beam 6. In the embodiment of FIG. 6*a* the attachment element 13 has at least a first arm 9, one end of which is attached by a fixed joint 16, such as a screw joint, to a first piece to be attached, i.e. to the feed beam 6 in the figure, and the other end of which by a ball joint 8 to a second piece to be attached, such as the block 12. Naturally a vice-versa joint is also possible, in which case the block 12 is the first piece to be attached and the feed beam 6 the second piece to be attached. When the ball joint is made of rubber 8, the attachment element 13 binds all linear movements but allows rotations. Added flexibility is provided by the arm 9, which in the case of FIG. 6*a* allows a movement along the x axis. In other words, the ball joint 8 may be imagined to rise upward from the plane of the paper or to descend downward from the plane of the paper. The support presented in FIG. 6*a* thus only binds two degrees of freedom, i.e. the transitions along the y and z axes shown schematically in FIG. 6*a*.

Figure 6B:
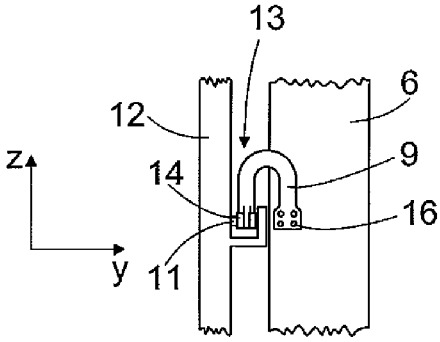

FIG. 6*b* is a schematic view of another attachment element 13 for attaching together the block 12 and the feed beam 6. In the embodiment of FIG. 6*b* the attachment element 13 has at least a first arm 9, one end of which is fastened by a fixed joint 16, such as a screw joint, to a first piece to be attached, i.e. to the feed beam 6 in the figure, the other end being fastened to a second piece to be attached, such as the block 12, by a trunnion 11 in the direction of the y axis. Naturally a vice-versa attachment is also possible in which case the block 12 is the first piece and the feed beam 6 the second piece to be attached. When the trunnion is mounted in the direction of the y axis, the trunnion itself binds all other degrees of freedom except the rotation or twisting about the y axis. However, if the arm 9 were made of a thin plate, it would as such be flexible also in relation to the rotation or twisting about the z axis. Hence the support would support two linear degrees of freedom, i.e. the directions of the y and z axes, and one rotating degree of freedom, i.e. the rotation taking place about the x axis running perpendicularly to the paper surface. Between the attachment element 13 and the first and/or the second piece to be attached it is possible to arrange a flexible attenuator 14 for preventing noise, for example, from travelling from one piece to another and yet allowing independent movement of the parts in relation to one another. In FIG. 6 this type of attenuator is arranged in connection with the trunnion 11.

Figure 7A:
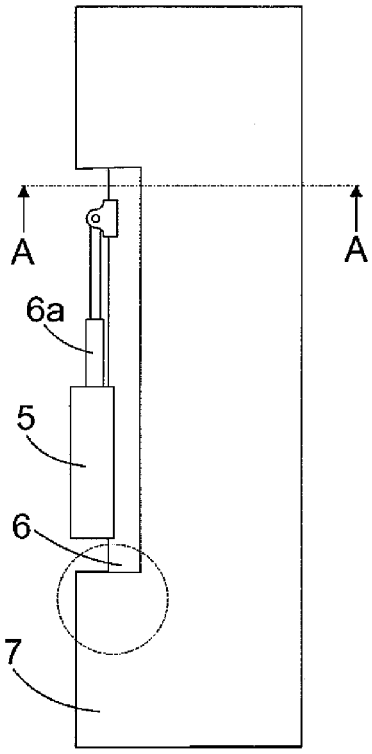
Figure 7B:
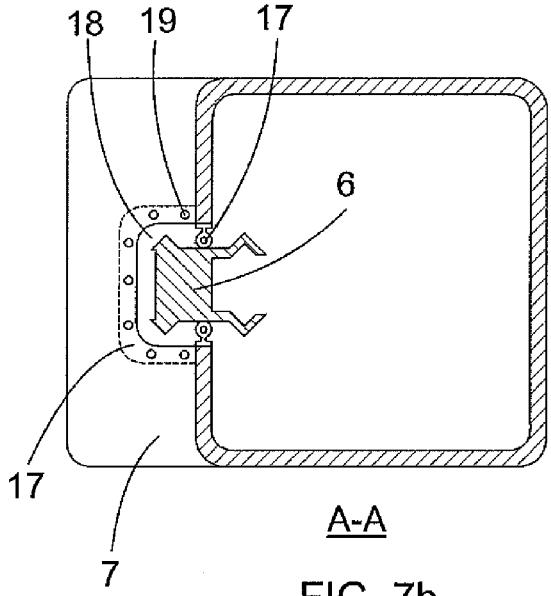
Figure 7C:
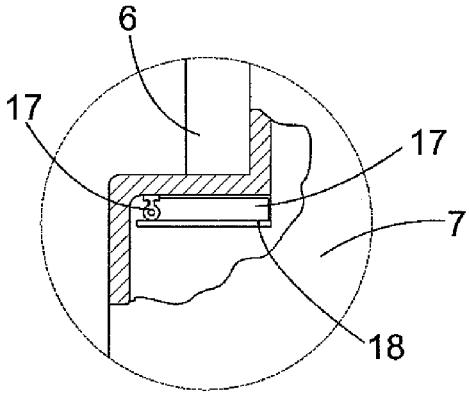

FIGS. 7*a*, 7*b* and 7*c* disclose an embodiment in which the feed beam 6 is entirely arranged inside the protective structure, except for the portions needed for attaching it to cradle 5 and for the track of the transfer cylinder 6*a*. In that case there is a movement joint formed between the feed beam 6 and the protective structure 7 to reduce forces and to seal the joint between the feed beam 6 and the protective casing although they move in relation to one another. FIG. 7*b* shows a schematic front view of the protective structure 7 along section A-A of FIG. 7*a*. FIG. 7*c* is a schematic view of a partial cross-section of a detail depicted with a broken line in FIG. 7*a*.

In the embodiment of FIGS. 7*a* to 7*c* the movement joint is formed with a sealing 17 arranged between the protective structure 7 and the feed beam 6 and a sealing plate 18 attached thereto. On the longitudinal sides of the feed beam 6 the sealing 17 of the movement joint is arranged parallel with this longitudinal direction between the feed beam 6 and the protective structure 7, as is shown in FIG. 7*b*, and on the portions around the feed beam 6 it is perpendicularly between the sealing plate 18 and the protective structure 7, as shown in FIG. 7*c* in particular. In that case the sealing plate 18 is attached to the feed beam 6 and follows its shape, the sealing 17 being attached to the protective structure 7 by attachment parts 19, for example. In other words, the sealing plate 18 is fastened to the feed beam 6 and moves with it. This type of movement joint is capable of receiving a movement of +/−10 mm, for example, without the purpose of use of the protective structure 7, such as its sound insulating capacity, being substantially impaired. As disclosed above, also in this embodiment the protective structure 7 may consist of one or more blocks 12.

Figure 8A:
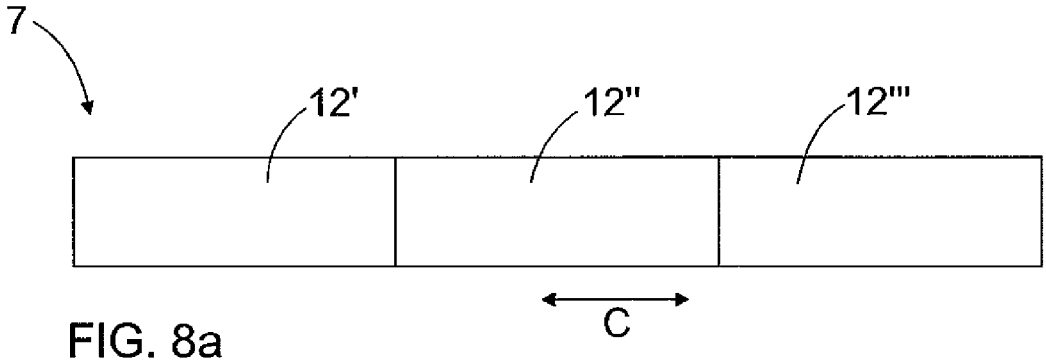
Figure 8B:
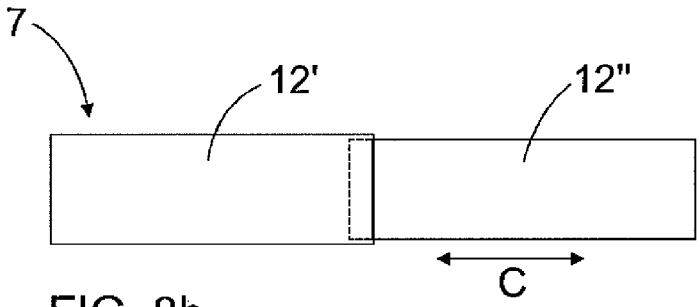
Figure 8C:
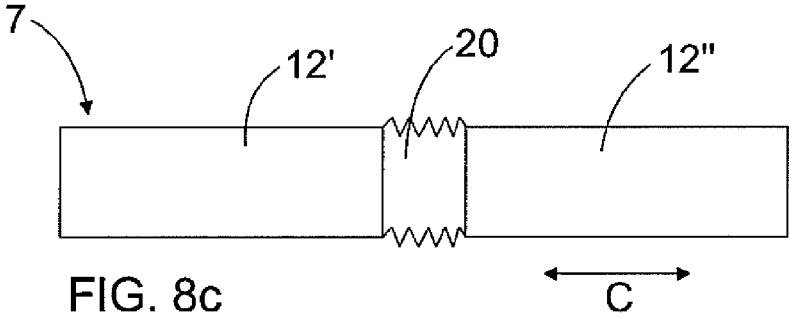

FIGS. 8*a* to 8*c* show a schematic view of embodiments of the protective structure 7 in which the protective structure 7 consists at least of two blocks arranged substantially successively in direction C of the feed beam 6, the blocks being designated by references 12', 12" and 12'" in the figure.

FIG. 8*a* shows a schematic view of an embodiment in which the protective structure 7 consists of three blocks 12', 12" and 12'" arranged substantially successively in direction C of the feed beam 6. When the number of blocks 12 selected for the length of the feed beam 6 is suitable, already this alone reduces the transfer of forces caused by the bending and twisting of the feed beam 6 to the block 12 irrespective of how the blocks are attached to the feed beam 6. The reason for this is that when the protective structure 7 is formed of a plural number of blocks 12, the bending and twisting on the length of each block 12 is correspondingly smaller than on the entire length of the protective structure 7. In other words, it is yet more preferable to form the protective structure 7 of three or more blocks 12. The shorter the blocks are, the fewer the problems caused by bending. Extremely short blocks may also be attached by a single attachment unit binding six degrees of freedom. However, as the number of blocks increases, so do the costs of sealing.

FIG. 8*b* shows a schematic view of an embodiment in which two blocks 12 of the protective structure, for example blocks 12' and 12" in the figure, arranged successively in longitudinal direction C of the feed beam are arranged together by providing a first block to be attached with an attachment end of a smaller cross-section than a second block to be attached, the attachment end of the first block being at least mostly arranged inside the end of the second block, this end being depicted by a broken line in the figure. In this type of embodiment the structures, materials and attachments may be designed either by allowing for each block a small rotation or twisting caused by the joint or by allowing the nested ends of the blocks 12 to rotate or twist in relation to one another. Rotation or twisting of the nested ends of the blocks 12 in relation to one another may be implemented either by providing the inside portion with a clearance that allows sufficient rotation or twisting of the ends in relation to each other or by providing the protective structure 7 with a profile that does not have sharp corners or other similar shapes preventing the nested block ends from rotating or twisting in rotating or twisting direction C of the feed beam. If the joint is provided with a clearance, it may be sealed to reduce noise.

FIG. 8*c* is a schematic view of an embodiment in which two blocks 12, for example 12' and 12" in the figure, arranged successively in longitudinal direction C of the feed beam are interconnected by a connecting member 20, which in the figure is a bellows. Instead of a bellows, any other resilient member may be used. The connecting member 20 preferably connects the blocks 12 to one another, allowing at the same time them to move in relation to each other. Between the blocks 12 of the protective structure 7 it is possible to arrange a resilient sealing, for example, that prevents propagation of noise but allows movement of the blocks 12 in relation to one another. The blocks 12 may be connected together at their ends, in which case the connecting member 20 is arranged between these ends, or the blocks 12 may be partially nested at their ends, if the profile of the blocks 12 allows this, i.e. the profile does not have corners or notches that would prevent the blocks 12 from rotating or twisting in relation to one another.

In an embodiment in which the protective structure 7 consists of more than one block, between the blocks of the protective structure 7 is provided a resilient sealing made of a resilient material, for example. This sealing prevents noise, for example, from travelling but allows independent movement of the blocks of the parts in relation to one another.

During drilling information of the depth of the hole to be drilled is conveyed to the drilling machine by means of a laser transmitter arranged at a location in the mine or the mining field and a laser receiver arranged to the drill carriage, the feed device or the feed beam. This arrangement requires a clear field of view between the transmitter and the receiver. When a drilling rig is provided with protective structures such as the ones described above or those of the prior art, the field of view between the transmitter and the receiver is obstructed. In that case the laser receiver cannot be placed to the drill carriage, feed device or feed beam unless the protective structure is made so that it can be opened to allow the field of view to be provided. However, this may prevent drilling, because an acceptable noise or safety level of the equipment is not necessarily maintained.

In devices provided with a protective structure the laser receiver must therefore be placed outside the construction forming the protective structure and in direct contact with the laser transmitter. Moreover, it is necessary that the laser receiver can be moved up and down to allow the laser field provided by the laser transmitter to be identified. In addition, the place of the laser receiver in the drilling rig must be known so that when the location of the drilling rig is known, it is possible to calculate the distance between the laser receiver and the drilling rig, which in turn allows the location of the drilling rig in relation to the laser beam level to be determined.

Figure 9:
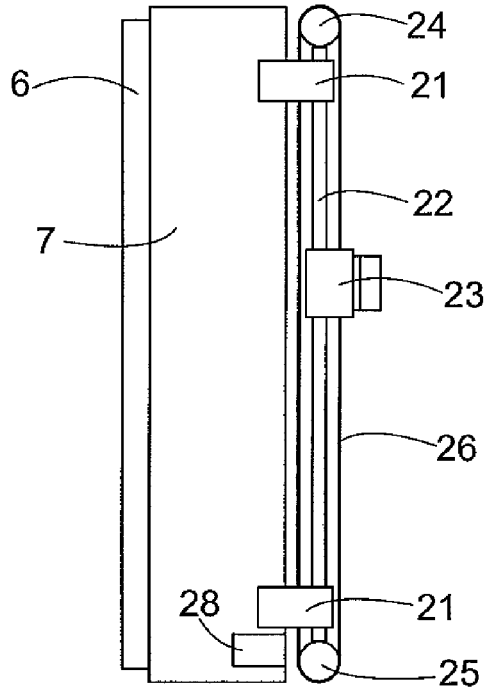
FIG. 9 is a schematic side view of an arrangement for placing a laser receiver used in rock drilling in association with the protective structure.

FIG. 9 is a schematic side view of an arrangement for placing a laser receiver used in rock drilling in connection with a protective structure. In the arrangement of FIG. 9 a slide runner 22 is attached by means of fastenings 21 outside the protective structure 7 arranged partly around the feed beam 6, a laser receiver 23 being movably supported to the slide runner. The arrangement further comprises means for moving the laser receiver 23 on the slide runner 22. In the arrangement of FIG. 9 these moving means include an electric motor 24, a sheave 25 and a toothed belt 26, the toothed belt 26 being connected to the laser receiver 23 and the electrical motor 24 so that by driving the electrical motor 24 the toothed belt 26 may be made to move around the electrical motor 24 or a part thereof and the sheave 25 in such a way that when the toothed belt 26 moves, the laser receiver 23 moves with it up and down when viewed according to FIG. 9, i.e. in the vertical or height direction of the protective structure 7 in FIG. 9. The position of the laser receiver 23 in the height direction of the protective structure 7 may be determined for example by a schematically shown measurement device 28, such as an absolute sensor, placed in the vicinity of the sheave 25 and arranged to measure the position of the laser receiver 23 on the basis of the amount of movement of the toothed belt 26 or the rotating movement of the sheave 23. For the sake of clarity the support of the electrical motor 24 and the sheave 25 to the protective structure is not disclosed.

An advantage of the arrangement of FIG. 9 is that the level of the laser beam may be reached by moving the laser receiver in the height direction of the protective structure through the laser beam transmitted by the laser transmitter without having to move the drill carriage, for example, at all. In addition, the level of the laser beam may be determined during drilling without disturbing the drilling works. The laser receiver may be placed more freely so that it is independent of the actual feed equipment, which allows the laser receiver to be placed to a position where the laser beam will most likely hit it.

Figure 10:
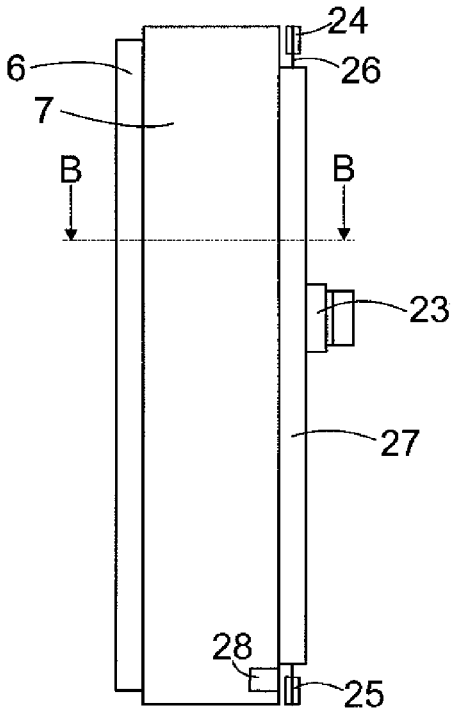
FIG. 10 is a schematic side view of another arrangement for placing a laser receiver used in rock drilling in association with the protective structure.
Figure 11:
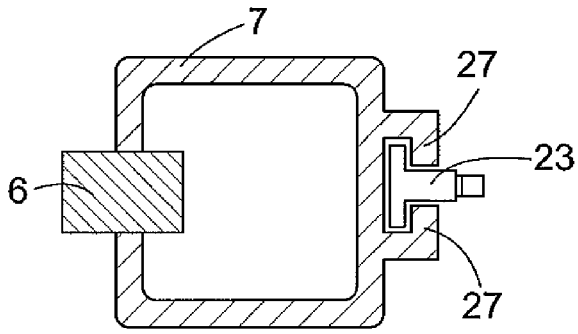
FIG. 11 is a schematic cross-sectional view of the arrangement of FIG. 10.

FIG. 10 is a schematic side view of a second arrangement for placing a laser receiver to be used in rock drilling to the protective structure, FIG. 11 showing the arrangement of FIG. 10 schematically in a cross-section along line B-B. In the arrangement of FIGS. 9 and 10 there are slide runners 27 formed in connection with and outside the protective structure 7 arranged around the feed beam 6, the slide runners having a laser receiver 23 movably supported thereto. The arrangement further includes moving devices for moving the laser receiver 23 on the slide runner 22. In the arrangement of FIGS. 10 and 11 the moving devices include an electrical motor 24, a sheave 25 and a toothed belt 26, the toothed belt 26 being connected to the laser receiver 23 and the electrical motor 24 so that by driving the electrical motor 24 the toothed belt 26 may be made to move around the electrical motor 24 or a part thereof and the sheave 25 in such a way that as the toothed belt 26 moves, the laser receiver 23 moves with it up and down when viewed as in FIG. 10, i.e. in the vertical or height direction of the protective structure 7 in FIG. 10. The position of the laser receiver 23 in the height direction of the protective structure 7 may be determined by a schematically shown measurement device 28, such as an absolute sensor, arranged to measure the position of the laser device 23 on the basis of the amount of movement of the toothed belt 26 or the amount of rotation of the sheave 23. For the sake of clarity the support of the electrical motor 24 or the sheave 25 to the protective structure is not shown.

In the arrangement of FIGS. 9 and 10 the slide runners 27 may be formed as a part of the protective structure 7 by means of a rotation casting method, because using the rotation casting method to make the protective structure 7 allows the slide runners 27 to be made at the same time as a uniform part of the protective structure 7 with the rotation casting technique. Slide runners manufactured this way are both dimensionally accurate and light. At the same time the slide runners are automatically obtained for the application where they are needed. In addition, when compared with the arrangement of FIG. 9, for example, fewer parts and their fastenings are needed. Rotation casting method also allows for technical designing to be used to provide the protective structure and the rock drilling rig as a whole with an outer appearance that is easy to shape as desired.

In some cases the features disclosed in this application may be used as such, independently of other features. On the other hand, the features disclosed in this application may be combined, when necessary, to provide different combinations.

The drawings and the related specification are only intended to illustrate the idea of the invention. The drawings are not presented in scale. The details of the invention may vary within the scope of the claims.

The invention claimed is:

1. A method for attaching a protective structure consisting of at least one block to a feed beam of rock drilling rig and at least partly around the feed beam, the feed beam being movably arranged through a cradle to a boom of the rock drilling rig, the method comprising:

attaching the block of the protective structure to the feed beam by attachment units consisting of one or more attachment elements, wherein at least one of the attachment elements comprises a joint, so that the block substantially maintains its original shape as the feed beam bends in a bending direction of its longitudinal axis and/or twists in a twisting direction about its longitudinal axis due to forces acting on the feed beam during the use of the rock drilling rig.

2. A method according to claim 1, wherein the protective structure is formed of at least two blocks.

3. A method according to claim 2, wherein the blocks are connected to each other by at least one connecting member that allows the parts to move in relation to each other.

4. A method according to claim 2, wherein a resilient sealing is arranged between the blocks of the protective structure to prevent noise from propagating but to allow the parts to move in relation to each other.

5. A method according to claim 1, wherein the block is attached to the feed beam either by one attachment unit of type A or one attachment unit of type or by three attachment units of type A, one type A attachment unit binding at least one linear degree of freedom and leaving all rotating or twisting degrees of freedom flexible or free and comprising one or more attachment elements located within an area of 1 meter in the direction of the longitudinal axis of the feed beam and linearly placed in such a way that twisting about the longitudinal axis of the feed beam is possible, and one type B attachment unit binding at least one linear degree of freedom and rotation or twisting taking place about the longitudinal axis of the feed beam, leaving the rest of the rotating or twisting degrees of freedom flexible or free, and comprising one or more attachment elements located within an area of 1 meter in the longitudinal direction of the feed beam.

6. A method according to claim 1, wherein the block of the protective cover is attached to the feed beam by an attachment solution implementing a support that binds six degrees of freedom at the most, the twisting direction and the bending direction of the feed beam being substantially free of over-support to minimize the transfer of forces caused by the twisting and bending of the feed beam to the block.

7. A protective structure of a rock drilling rig to be arranged at least partly around a feed beam of the rock drilling rig, the feed beam being movably arranged through a cradle to a boom of the rock drilling rig and the protective structure consisting of at least one block, the block of the protective structure is being provided with attachment units consisting of one or more attachment elements, wherein at least one of the attachment elements comprises a joint, for attaching the block to the feed beam in such a way that when attached to the feed beam the protective structure substantially maintains its shape as the feed beam bends in the bending direction of its longitudinal axis and/or twists about its longitudinal axis in the twisting direction due to forces acting on the feed beam during the use of the rock drilling rig.

8. A protective structure according to claim 7, wherein the protective structure consist of at least two blocks.

9. A protective structure according to claim 8, wherein the blocks may be connected to one another by at least one connecting member that allows the parts to move in relation to one another.

10. A protective structure according to claim 8, wherein a resilient sealing may be arranged between the blocks of the protective structure preventing propagation of noise but allowing the parts to move in relation to one another.

11. A protective structure according to claim 7, wherein the block is provided with either one attachment unit of type A or one attachment unit of type or three attachment units of type A for attaching the block to the feed beam, one type A attachment unit binding at least one linear degree of freedom and leaving all rotating or twisting degrees of freedom flexible or free and comprising one or more attachment elements located within an area of 1 meter in the direction of the longitudinal axis of the feed beam and are linearly placed in such a way that twisting about the longitudinal axis of the feed beam is possible, and one type B attachment unit binding at least one linear degree of freedom and twisting taking place about the longitudinal axis of the feed beam, leaving the rest of the rotating or twisting degrees of freedom flexible or free, and comprising one or more attachment elements located within an area of 1 meter in the longitudinal direction of the feed beam.

12. A protective structure according to claim 7, wherein the block is provided with attachment units for attaching the block to the feed beam and that when attached to the feed beam the attachment units of the block form a support binding six degrees of freedom at the most, the twisting direction and the bending direction of the feed beam being substantially free of over-support to minimize the transfer of forces to the block due to the twisting and bending of the feed beam.

13. A protective structure according to claim 7, wherein the protective structure is a sound dampening casing.

14. A protective structure according to claim 7, wherein the protective structure is a safety net.

15. A protective structure according to claim 7, wherein in connection with the protective structure there are provided runner structures for supporting a laser receiver used in drilling to the protective structure and means for moving the laser receiver in the runner structures in relation to the protective structure.

16. A protective structure according to claim 7, wherein the protective structure is manufactured with a rotation casting method.

* * * * *